US005747979A

United States Patent [19]

Nagai

[11] Patent Number: 5,747,979

[45] Date of Patent: May 5, 1998

[54] MULTIPLE VALUE VOLTAGE OUTPUT CIRCUIT AND LIQUID CRYSTAL DISPLAY DRIVING CIRCUIT

[75] Inventor: Atsushi Nagai, Tenri, Japan

[73] Assignee: Sharp Kabushiki Kaisha, Osaka, Japan

[21] Appl. No.: 678,329

[22] Filed: Jul. 11, 1996

[30] Foreign Application Priority Data

Sep. 12, 1995 [JP] Japan ..... 7-234322
Sep. 27, 1995 [JP] Japan ..... 7-249512

[51] Int. Cl.[6] ..... G05F 1/12

[52] U.S. Cl. ..... 323/349; 323/351; 326/80

[58] Field of Search ..... 323/349, 350, 323/351; 363/59, 60, 61, 62; 326/80, 81

[56] References Cited

U.S. PATENT DOCUMENTS 4,882,534 11/1989 Koshizuka ..... 323/351
5,265,003 11/1993 Kayser et al. ..... 323/351 X
5,506,493 4/1996 Stengel ..... 323/351 X
5,537,059 7/1996 Asahina ..... 326/81
5,543,744 8/1996 Okumura ..... 326/81 X

FOREIGN PATENT DOCUMENTS 5046113 2/1993 Japan .

*Primary Examiner*—Peter S. Wong
*Assistant Examiner*—Y. J. Han

[57] ABSTRACT

A multiple value voltage output circuit in which the number of transistors configuring a high breakdown voltage circuit portion can be reduced so that the area for forming the circuit is reduced. In a signal electrode driving circuit 11, an inverted AC-converting signal FRR inputted to switching control circuits 12 and 13 is selectively inputted to transistors 41 to 44 of an output buffer 14, on the basis of a data signal DA, thereby make one of the transistors 41 to 44 conduct so that a voltage corresponding to the turned-ON of the transistors 41 to 44 is outputted through an output terminal 15.

6 Claims, 17 Drawing Sheets

MULTIPLE VALUE VOLTAGE OUTPUT CIRCUIT AND LIQUID CRYSTAL DISPLAY DRIVING CIRCUIT

BACKGROUND OF THE INVENTION

1. Field of the Invention

The present invention relates to a multiple value voltage output circuit which selectively outputs one of plural voltages in accordance with an input signal, and to a liquid crystal driving circuit which supplies the selected voltage to a liquid crystal display panel so as to conduct a display operation.

2. Description of the Related Art

When a liquid crystal is to be driven so as to conduct a display operation, voltages which are to be applied to the liquid crystal material, or on-level and off-level voltages are determined so as to be respectively on both sides of the threshold voltage. In a liquid crystal display panel or the like, the AC driving or the so-called duty driving operation is conducted and hence a driving circuit which selectively outputs multiple value voltages is required.

FIG. 19 is a circuit diagram of a driving circuit 101 which is a typical prior art example, and FIG. 20 is a circuit diagram showing the driving circuit 101 in more detail or in terms of transistors. The driving circuit 101 comprises a control circuit 102, an output buffer 103, and an output terminal 104. The control circuit 102 comprises two NAND gates 106 and 107, and two NOR gates 108 and 109.

The output buffer 103 comprises transistors 110 and 111 which are P-channel MOSFETs (Metal Oxide Semiconductor Field Effect Transistor, hereinafter often referred to as "P-type FET" or "P-channel transistor" 110 and 111, and N-channel MOSFETs (hereinafter often referred to as "N-type FET" or "N-channel transistor") 112 and 113. Hereinafter, an FET is often referred to as merely "transistor."

In the driving circuit 101, a data signal DA, an AC-converting signal FR, and an inverted data signal DAR are inputted to the control circuit 102. The data signal DA is a signal for defining a voltage outputted through the output terminal 104. A signal which is obtained by inverting the level of the data signal DA is used as the inverted data signal DAR. The AC-converting signal FR is a signal for inverting the voltage outputted through the output terminal 104, at intervals of a predetermined period. When the signals inputted to the control circuit 102 are at high level, the signals are shifted by a level shifter (not shown), to a voltage VEE which is determined so as to be higher than a voltage V0 described later, and, when the signals are at low level, the signals are shifted to the ground voltage or a predetermined reference voltage which is lower than the voltage VEE.

In the control circuit 102, the data signal DA is inputted to one input of the NAND gate 106, and the AC-converting signal FR to the other input. The output P1 of the NAND gate 106 is connected to the gate G of the transistor 110. The inverted data signal DAR is inputted to one input of the NOR gate 108, and the AC-converting signal FR to the other input. The output P2 of the NOR gate 108 is connected to the gate G of the transistor 113.

The inverted data signal DAR is inputted to one input of the NAND gate 107, and the data signal DA to one input of the NOR gate 109. The AC-converting signal FR is inputted to the other inputs of the NAND gate 107 and the NOR gate 109. The output P3 of the NAND gate 107 is inputted to the gate G of the transistor 111, and the output P4 of the NOR gate 109 to the gate G of the transistor 112.

In the output buffer 103, the voltage V0 is supplied to the source S of the transistor 110 so that, when the output P1 applied to the gate G is of low level, the voltage V0 is connected through the output terminal 104 to, for example, an electrode of a liquid crystal display panel connected to the output terminal 104. A voltage V2 is supplied to the source S of the transistor 111 so that, when the output P3 applied to the gate G is of low level, the voltage V2 is outputted through the output terminal 104. A voltage V3 is supplied to the source S of the transistor 112 so that, when the output P4 applied to the gate G is of high level, the voltage V3 is outputted through the output terminal 104. A voltage V5 is supplied to the source S of the transistor 113 so that, when the output P2 applied to the gate G is of high level, the voltage V5 is outputted through the output terminal 104. The voltages including the ground voltage VG and the voltage VEE are determined so as to be $VEE \geqq V0 > V2 > V3 > V5 \geqq VG$.

As shown in FIG. 20, each gate device of the control circuit 102 consists of four transistors. The NAND gate 106 consists of transistors 121 and 122 which are P-type FETs, and transistors 123 and 124 which are N-type FETs. The voltage VEE is supplied to the sources S of the transistors 121 and 122, and their drains D are connected to each other. The transistors 123 and 124 are cascade-connected. The source S of the transistor 124 is grounded. The drain D of the transistor 123 is connected commonly to the transistors 121 and 122.

The voltage at the node of the transistors 121 and 122 and the transistor 123 is outputted as the output P1. The data signal DA is inputted to the gates G of the transistors 122 and 124, and the AC-converting signal FR to the gates G of the transistors 121 and 123.

The NOR gate 108 consists of transistors 125 and 126 which are P-type FETs, and transistors 127 and 128 which are N-type FETs. The transistors 125 and 126 are cascade-connected. The voltage VEE is supplied to the source S of the transistor 125. The drains D of the transistors 127 and 128 are connected to each other and their sources S are grounded.

The drain D of the transistor 126 is connected commonly to the drains D of transistors 127 and 128. The voltage at the node is outputted as the output P2. The inverted data signal DAR is inputted to the gates G of the transistors 125 and 128, and the AC-converting signal FR is inputted to the gates G of the transistors 126 and 127.

The NAND gate 107 consists of transistors 129 and 130 which are P-type FETs, and transistors 131 and 132 which are N-type FETs. The transistors 129 to 132 correspond to the transistors 121 to 124, respectively, and are connected to each other in the same manner as the transistors 121 to 124. The voltage at the node of the drains D of the transistors 129 and 130 and the drain D of the transistor 131 is outputted as the output P3. The inverted data signal DAR is inputted to the gates G of the transistors 130 and 132, and the AC-converting signal FR is inputted to the gates G of the transistors 129 and 131.

The NOR gate 109 consists of transistors 133 and 134 which are P-type FETs, and transistors 135 and 136 which are N-type FETs. The transistors 133 to 136 correspond to the transistors 125 to 128, respectively, and are connected to each other in the same manner as the transistors 125 to 128. The voltage at the node of the drain D of the transistor 134 and the drains D of the transistors 135 and 136 is outputted as the output P4. The data signal DA is inputted to the gates G of the transistors 133 and 136, and the AC-converting signal FR is inputted to the gates G of the transistors 134 and 135.

The following Table 1 shows a table of truth value of the driving circuit 101.

TABLE 1

| DA | FR | P1 | P2 | P3 | P4 | Tr110 | Tr111 | Tr112 | Tr113 | Output voltage |
|---|---|---|---|---|---|---|---|---|---|---|
| L | L | H | L | H | H | OFF | OFF | ON | OFF | V3 |
| L | H | H | L | L | L | OFF | ON | OFF | OFF | V2 |
| H | L | H | H | H | L | OFF | OFF | OFF | ON | V5 |
| H | H | L | L | H | L | ON | OFF | OFF | OFF | V0 |

In Table 1, when the data signal DA is at high "H" level and the AC-converting signal FR is at high "H" level, for example, the outputs P1, P2, and P4 are of low "L" level and the output P3 is of high "H" level. Among the transistors 110 to 113 which are shown as Tr110 to Tr113 in Table 1, therefore, only the transistor 110 is turned ON so that the voltage V0 is outputted through the output terminal 104.

In accordance with the levels of the data signal DA and the AC-converting signal FR, one of the transistors 110 to 113 is turned ON so that the voltage supplied to the transistor is outputted through the output terminal 104.

In order to conduct a display operation on such a liquid crystal display panel, a driving voltage of about 30 to 50 V must be applied to drive the liquid crystal. The driving circuit 101 which outputs multiple value voltages must be a high breakdown voltage circuit so that, even when such a driving voltage is applied, the circuit is prevented from breaking down. In order to ensure that, even when the driving voltage is applied, the circuit is prevented from breaking down, the transistors of the circuit must have a special structure such as the double-diffusion structure. This causes the area required for forming the circuit, to be increased. In a semiconductor chip wherein the liquid crystal driving circuit is formed, the proportion of the area occupied by high breakdown voltage circuits is increased.

Recently, it is requested to reduce the production cost of a panel set containing a liquid crystal display panel and an apparatus for driving the display panel. In order to reduce the production cost, it may be contemplated to reduce the area of the whole of the semiconductor chip. And in order to reduce the area of the semiconductor chip, it is necessary to solve a problem that the area occupied by high breakdown voltage circuits must be reduced.

There is another problem that the power consumption of the panel set is large. In a driver IC comprising the above-mentioned driving circuit 101, at the time when the rise and fall of the signals DA and DR inputted to the control circuit 102 are changed, two of the transistors 110 to 113 of the output buffer 103 are simultaneously put into ON-state for a moment, and a so-called through current flows. For example, when the data signal DA and the AC-converting signal FR are at high level and the AC-converting signal FR then falls to low level, the transistors 110 and 113 are simultaneously put into ON-state and a current flows from the side of the voltage V0 to the side of the voltage V5.

A prior art of preventing increase of the power consumption due to a through current is disclosed in Japanese Unexamined Patent Publication JP-A 5-46113 (1993). In the prior art, input signals are made different in phase from each other by disposing a delay circuit consisting of inverter gates, capacitors, etc., so that transistors of an output buffer are not simultaneously put into ON-state, thereby preventing a through current from flowing. According to the prior art technique, an output circuit portion of a driver IC is configured by a number of circuit devices, and hence there is the possibility that the area of a semiconductor chip becomes large and the production cost is increased.

SUMMARY OF THE INVENTION

It is an object of the invention to provide a multiple value voltage output circuit and a liquid crystal driving circuit in which the area of a semiconductor chip is reduced by a reduced number of transistors configured as high breakdown voltage circuits.

It is another object of the invention to provide a multiple value voltage output circuit and a liquid crystal driving circuit in which a through current is prevented from flowing by a reduced number of circuit devices and thereby the power consumption is reduced.

The invention provides a multiple value voltage output circuit which selectively outputs one of plural voltages in accordance with a first input signal whose level is sifted at intervals of a predetermined period from a first power source potential to a second power source potential or from the second power source potential to the first power source potential, and a second input signal whose level is determined to be one of the first and second power source potentials at intervals of a predetermined reference period shorter than the predetermined period, the multiple value voltage output circuit comprising:

plural first switching devices each having one end connected to a corresponding voltage among the plural voltages and another end connected to an output terminal in common; and a control circuit for outputting a control signal by which one of the plural first switching devices is put into conduction state, and the others of the plural first switching devices are put into cutoff state, wherein the control circuit comprises a logic circuit for each first switching devices composed of two second switching devices which are cascade-connected to each other, either of the cascade-connected second switching devices is put into conduction state in accordance with the second input signal, the first or second power source potential is supplied to one end of the cascade-connected second switching devices, the first input signal is supplied to the other end of the cascade-connected second switching devices, and a potential of the node of the cascade-connected second switching devices is used as the control signal for the corresponding first switching device.

According to the multiple value voltage output circuit of the invention, when the second input signal is inputted to each logic circuit, either of each two second switching devices is put into conduction state, and the second input signal is fed to the corresponding first switching device as the control signal. In response to the control signal, only one of the first switching devices is put into conduction state. The voltage supplied to the switching device in conduction state is outputted through an output terminal. The control signal for controlling conduction and cutoff of the first switching device is the potential of the node of the two second switching devices in the logic circuit. Therefore, the first or second power source potential supplied to the logic circuit is selectively supplied to the first switching device, thereby causing conduction of the first switching device.

As shown in FIG. 1, for example, the multiple value voltage output circuit 1 comprises a control circuit 2 and first switching devices 3*a* and 3*b*. The control circuit 2 consists of two logic circuits 4*a* and 4*b*. In the logic circuit 4*a*, two second switching devices 5*a* and 5*b* are cascade-connected, a first power source potential VA1 is supplied to the second switching device 5*a*, and a first input signal S1 is supplied to the second switching device 5*b*. In the logic circuit 4*b*, two second switching devices 5*c* and 5*d* are cascade-connected, a first input signal S1 is supplied to the second switching device 5*c*, and a second power source potential VA2 is supplied to the second switching device 5*d*. The level of the first input signal S1 alternatingly is shifted at intervals of a predetermined period from the first power source potential VA1 to the second power source potential VA2 and vice versa.

The potential at the node of the second switching devices 5*a* and 5*b* cascade-connected is inputted as the control signal to the first switching device 3*a* and conduction and cutoff of the switching device are controlled depending on the potential level. The potential of the node of the second switching devices 5*c* and 5*d* is inputted as the control signal to the first switching device 3*b* and conduction and cutoff of the switching device are controlled depending on the level of the potential. A second input signal S2 is inputted as the control signal to the second switching devices 5*a* to 5*d*. In accordance with the second input signal S2, one of the second switching devices 5 in each logic circuit 4*a*, 4*b* is put into conduction state. The level of the second input signal S2 is alternatingly shifted from the first power source potential VA1 to the second power source potential VA2 and vice versa, at each elapse of a reference time which is shorter than the predetermined period.

In response to the control signals outputted from the logic circuits, one of the first switching devices 3 is put into conduction state and the voltage VB supplied to the first switching device 3 is outputted through an output terminal 6.

The invention is characterized in that:

the first switching device connected to a voltage of a value equal to or higher than a predetermined value is composed of a P-channel transistor, and the logic circuit which outputs the control signal to the P-channel transistor is composed of a first logic circuit configured by a circuit of cascade connected P-channel transistors, to one end of which a power source potential for putting the P-channel transistor into cutoff state is supplied, and the first switching device connected to a voltage of a values lower than the predetermined value is composed of an N-channel transistor, and the logic circuit which outputs the control signal to the N-channel transistor is composed of a second logic circuit configured by a circuit of cascade-connected N-channel transistors, to one end of which a power source potential for putting the N-channel transistor into cutoff state is supplied.

According to the invention, conduction and cutoff of the first switching device which is a P-channel transistor are controlled by the control signal outputted from the first logic circuit to one end of which a power source potential for putting the P-channel transistor into cutoff state is supplied. Conduction and cutoff of the first switching device which is an N-channel transistor are controlled by the control signal outputted from the second logic circuit to one end of which a power source potential for putting the N-channel transistor into cutoff state is supplied. Therefore, either the power source potential for putting the P-channel transistor into cutoff state, supplied to the first logic circuit, or the first input signal is inputted to the first switching device composed of a P-channel transistor, with the result that the first switching device is cut off except when it conducts in accordance with the voltage level of the first input signal. On the other hand, with respect to the first switching device composed of a N-channel transistor, either the power source potential for putting the N-channel transistor into cutoff state, supplied to the second logic circuit, or the first input signal is inputted to the first switching device composed of an N-channel transistor, with the result that the first switching device is cutoff except when it conducts in accordance with the voltage level of the first input signal. Since the power source potential for putting the transistor connected to each logic circuit into cutoff state is supplied to one end of each logic circuit, the corresponding first switching device can be completely turned off.

The invention is characterized in that the first and second logic circuits are cascade-connected between the first and second power source potentials, and the first input signal is supplied to the node of the first and second logic circuits.

According to the invention, the first and second logic circuits are cascade-connected between the first and second power source potentials, and the first input signal is supplied to the node of the first and second logic circuit. Therefore, the first input signal and the first and second power source potentials are supplied to the first switching device through the logic circuit which is put into conduction state by the second input signal.

As shown in FIG. 2, a first logic circuit 7 configured by second switching devices 5*e* and 5*f* which are P-channel transistors, and a second logic circuit 8 configured by second switching devices 5*g* and 5*h* which are N-channel transistors are cascade-connected. The first input signal S1 is inputted to the node of the first and second logic circuits 7 and 8.

The invention is characterized in that the first input signal supplied to the other end of the first logic circuit is made different in phase from the first input signal supplied to the other end of the second logic circuit, to ensure a period during which, when the levels of the first input signals are shifted, the voltages of both ends of all the logic circuits are equal to each other.

According to the invention, the first input signals respectively inputted to the first and second logic circuits are signals which are different in phase from each other. When the levels of the first input signal are shifted, therefore, a period during which all the voltages across the logic circuits are equal to each other is ensured.

As shown in FIG. 3, the first power source potential VA1 is supplied to one end of a first logic circuit 7*a*, and a first input signal S11 is supplied to the other end. The second power source potential VA2 is supplied to one end of a second logic circuit 8*a*, and a first input signal S12 which is different in phase from the first input signal S11 is supplied to the other end.

When the levels of the first input signals S11 and S12 are to be shifted, the first and second logic circuits 7*a* and 8*a* supply potentials for putting the switching devices 3 respectively corresponding to the logic circuits into cutoff state. Therefore, a through current which may be caused to flow by conduction of two first switching devices 3 is prevented from flowing, thereby reducing the power consumption of the multiple value voltage output circuit.

The invention is characterized in that the first input signal is an AC-converting signal whose level is shifted for each frame, and the second input signal is a data signal whose level is determined in accordance with data to be displayed.

According to the invention, the first input signal is an AC-converting signal whose level is shifted for each frame, and the second input signal is a data signal whose level is determined in accordance with data to be displayed. Therefore, the power source voltage supplied to the first switching device which is determined in accordance with the data signal is outputted through the output terminal.

The invention is characterized in that the first input signal is an AC-converting signal whose level is shifted for each frame, and the second input signal is a scan timing signal.

According to the invention, the first input signal is an AC-converting signal whose level is shifted for each frame, and the second input signal is a scan timing signal. Therefore, the power source voltage supplied to the first switching device which is determined in accordance with the scan timing signal is outputted through the output terminal.

As described above, according to the invention, the control signal for controlling conduction and cutoff of the first switching device is the voltage of the node of the two second switching devices in the logic circuit, and hence the first and second power source voltages supplied to the logic circuit are selectively supplied to the first switching device, thereby causing conduction of the first switching device. Since the first and second power source potentials supplied to the first switching device are high, each logic circuit must be formed as a high-voltage circuit. However, the first input signal which is to be inputted to the logic circuit is not inputted to a dedicated switching device but as the control signal to the first switching device through the second switching device in which conduction and cutoff are controlled by the second input signal. Consequently, the number of switching devices of the logic circuit can be reduced so that the area of the multiple value voltage output circuit is reduced.

According to the invention, in each of the logic circuits, a power source potential for putting a transistor connected to the logic circuit into cutoff state is supplied to one end, and hence the corresponding first switching device can be completely turned off.

According to the invention, the first and second logic circuits are cascade-connected between the first and second power source voltages, and the first input signal is supplied to the node of the first and second logic circuits. Therefore, the first and second power source potentials and the first input signals are outputted from the logic circuit which is put into conduction state by the second input signal, with the result that conduction and cutoff of the first switching device can be controlled.

According to the invention, the first input signals respectively inputted to the first and second logic circuits are signals which are different in phase from each other. When the levels of the first input signals are shifted, therefore, a period during which all the voltages across the logic circuits are equal to each other is produced. This prevents a through current from flowing through the two first switching devices.

According to the invention, the first input signal is an AC-converting signal the level of which is shifted for each frame, and the second input signal is a data signal the level of which is determined in accordance with data to be displayed. Therefore, the power source potential which is selected in accordance with the data signal and the AC-converting signal is outputted, resulting in that the liquid crystal can be driven by the power source potential which is applied in AC driving.

According to the invention, the first input signal is an AC-converting signal the level of which is shifted for each frame, and the second input signal is a scan timing signal. Therefore, the power source potential which is selected in accordance with the scan timing signal and the AC-converting signal is outputted, resulting in that the liquid crystal can be driven by the power source potential which is applied in AC driving.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
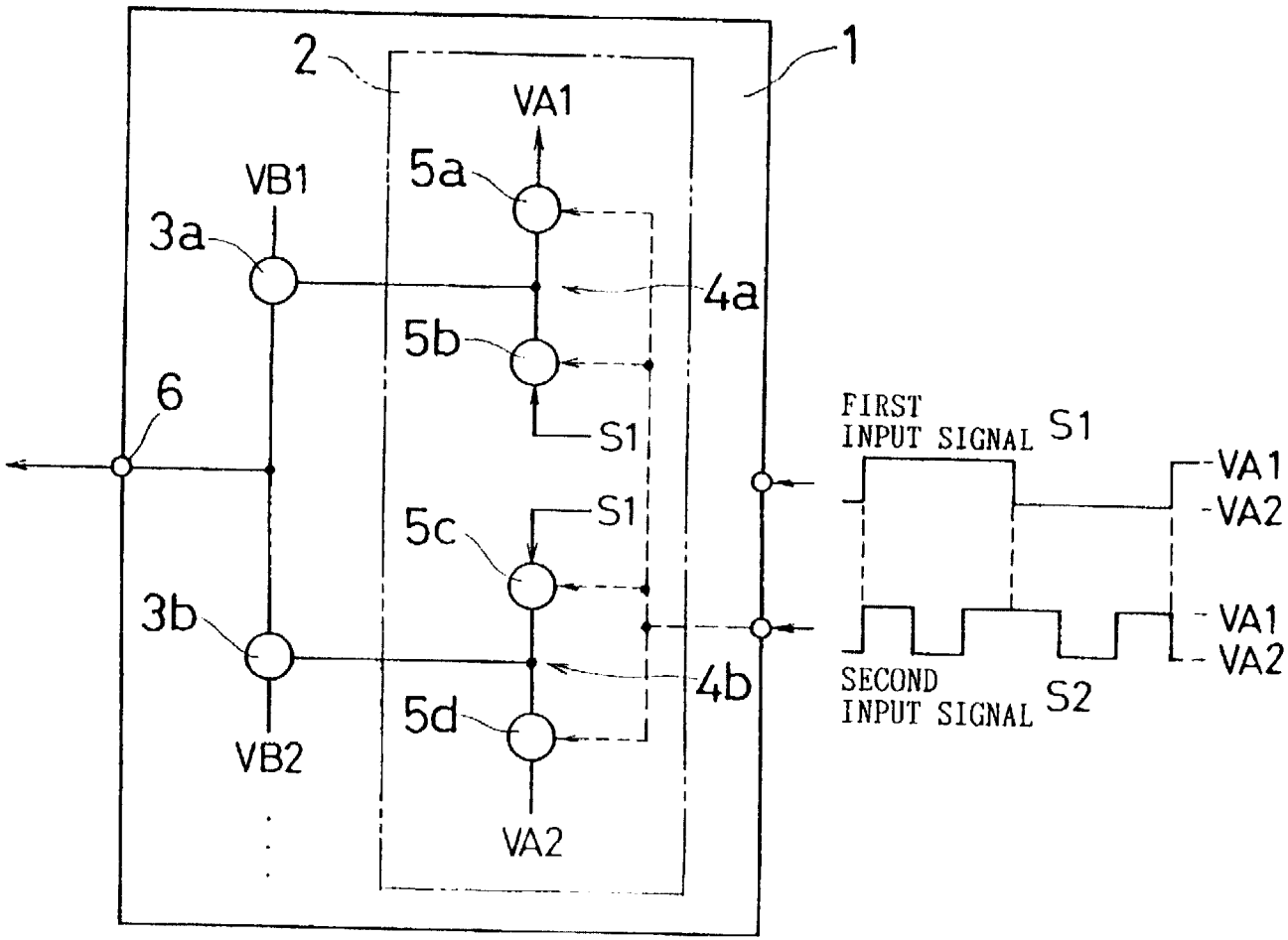
FIG. 1 is a diagram showing a basic concept of a first embodiment of the invention.

Now referring to the drawings, preferred embodiments of the invention are described below.

Figure 2:
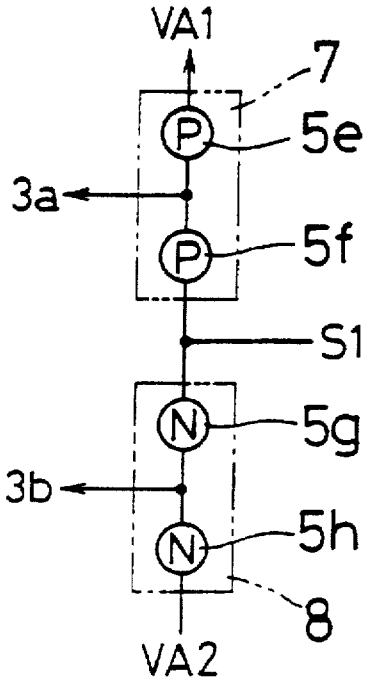
FIG. 2 is a diagram showing the basic concept of the first embodiment of the invention.
Figure 4:
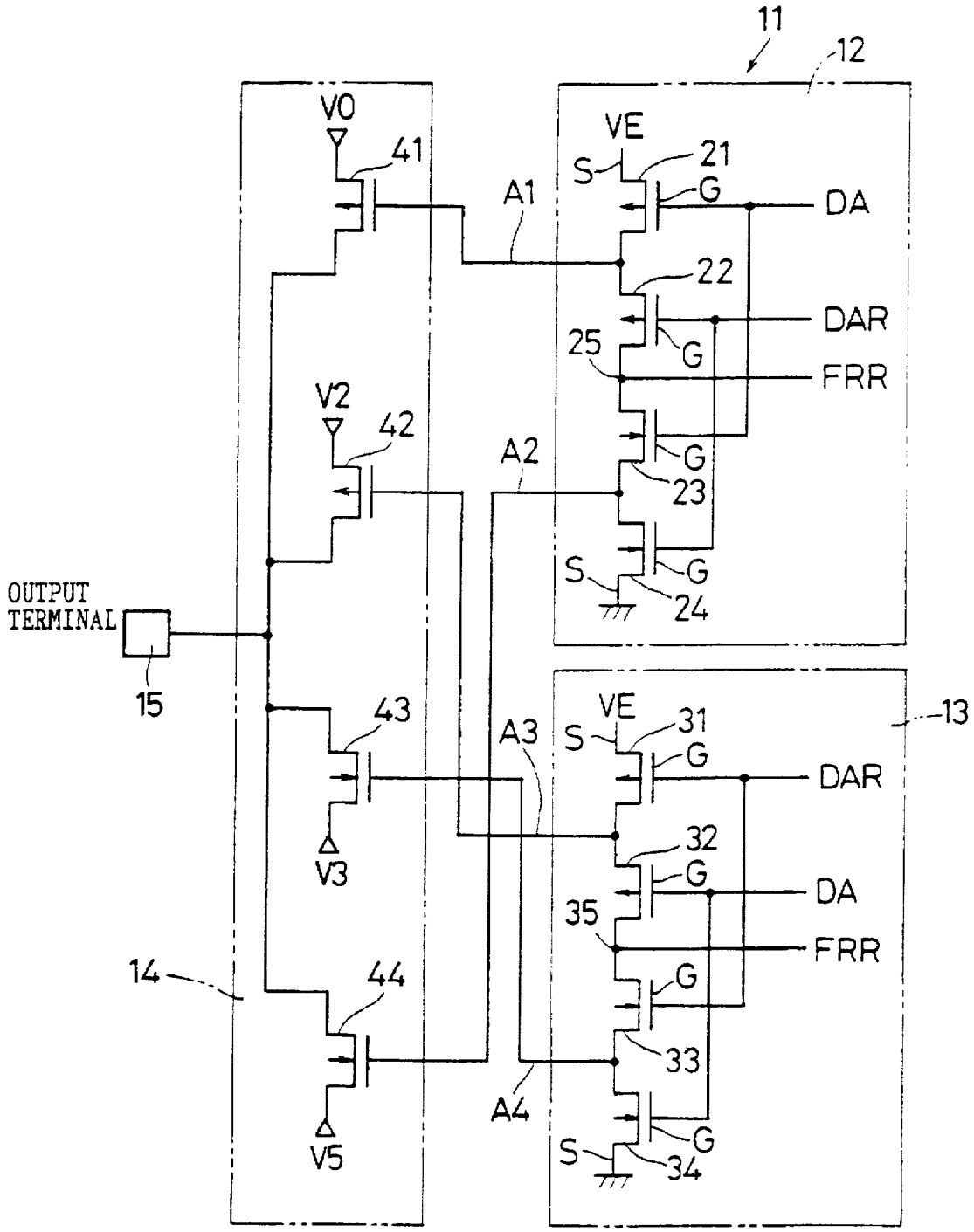
FIG. 4 is a circuit diagram of a signal electrode driving circuit 11 of the first embodiment of the invention.

FIG. 4 is a circuit diagram of a signal electrode driving circuit 11 of a first embodiment of the invention. FIGS. 1 and 2 show a basic concept of the first embodiment of the invention. The signal electrode driving circuit 11 comprises a first switching circuit 12, a second switching circuit 13, an output buffer 14, and an output terminal 15. The signal electrode driving circuit 11 is supplied with predetermined voltages from a power source circuit 56 which will be described later. Namely, a voltage VE is supplied to the first and second switching circuits 12 and 13, and voltages V0, V2, V3, and V5 are supplied to the output buffer 14. When the ground voltage is indicated by VG, the voltages are determined so as to be VE≧V0>V2>V3>V5 ≧VG.

A data signal DA, a signal DAR which is obtained by inverting the level of the data signal DA, and a signal FRR which is obtained by inverting the level of an AC-converting signal FR are inputted to the switching circuits 12 and 13 which control conduction and cutoff of transistors of the output buffer 14. The signals are signals whose levels have been shifted by a level shifter 68 which will be described below.

The first switching circuit 12 comprises transistors 21 and 22 which are P-channel FETs, and transistors 23 and 24 which are N-channel FETs. In the first switching circuit 12, the transistors 21, 22, 23, and 24 are cascade-connected in this sequence. The voltage VE is supplied to the source S of the transistor 21, and the source S of the transistor 24 is grounded.

The data signal DA is inputted to the gates G of the transistors 21 and 23, and the signal DAR is inputted to the gates G of the transistors 22 and 24. The signal FRR is inputted to the node 25 of the transistors 22 and 23. The level of the node of the transistors 21 and 22 is used as a signal A1, and that of the node of the transistors 23 and 24 as a signal A2.

The following Table 2 shows the truth table of the first switching control circuit 12.

TABLE 2

| DA | FR | Tr21 | Tr22 | Tr23 | Tr24 | A1 | A2 |
|---|---|---|---|---|---|---|---|
| L | L | ON | OFF | OFF | ON | H | L |
| L | H | ON | OFF | OFF | ON | H | L |
| H | L | OFF | ON | ON | OFF | H | H |
| H | H | OFF | ON | ON | OFF | L | L |

In Table 2, when the data signal DA is at low "L" level, the signal A1 is at high level and the signal A2 is at low level irrespective of the level of the AC-converting signal FR. In the case where the data signal DA is at high level, when the AC-converting signal FR is at low level, both the signals A1 and A2 are at high level, and, when the AC-converting signal FR is at high level, both the signals A1 and A2 are at low level.

In the second switching circuit 13, transistors 31 to 34 correspond to the transistors 21 to 24 of the first switching circuit 12, respectively, and are cascade-connected in the same manner as the transistors 21 to 24.

The signal DAR is inputted to the gates G of the transistors 31 and 33, and the data signal DA is inputted to the gates G of the transistors 32 and 34. The signal FRR is inputted to the node 35 of the transistors 32 and 33. The level of the node of the transistors 31 and 32 is used as a signal A3, and that of the node of the transistors 33 and 34 as a signal A4.

The following Table 3 shows the truth table of the second switching control circuit 13.

TABLE 3

| DA | FR | Tr31 | Tr32 | Tr33 | Tr34 | A3 | A4 |
|---|---|---|---|---|---|---|---|
| L | L | OFF | ON | ON | OFF | H | H |
| L | H | OFF | ON | ON | OFF | L | L |
| H | L | ON | OFF | OFF | ON | H | L |
| H | H | ON | OFF | OFF | ON | H | L |

In Table 3, when the data signal DA is at high level, the signal A3 is at high level and the signal A4 is at low level irrespective of the level of the AC-converting signal FR. In the case where the data signal DA is at low level, when the AC-converting signal FR is at low level, both the signals A3 and A4 are at high levels, and, when the AC-converting signal FR is at high level, both the signals A1 and A2 are at low level.

The output buffer 14 comprises transistors 41 and 42 which are P-channel FETs, and transistors 43 and 44 which are N-channel FETs. The outputs of the transistors 41 to 44 which are first switching devices of the output buffer 14 are supplied to the output terminal 15. The voltage V0 is supplied to the transistor 41, and conduction and cutoff of the transistor are controlled by the signal A1. The transistor 41 outputs the voltage V0 to the output terminal 15 in accordance with the level of the signal A1.

The voltage V2 is supplied to the transistor 42, and conduction and cutoff of the transistor are controlled by the signal A3. The voltage V3 is supplied to the transistor 43, and conduction and cutoff of the transistor are controlled by the signal A4. The voltage V5 is supplied to the transistor 44, and conduction and cutoff of the transistor are controlled by the signal A2.

The following Table 4 shows the truth table of the output buffer 14.

TABLE 4

| A1 | A2 | A3 | A4 | Tr41 | Tr42 | Tr43 | Tr44 | Output voltage |
|---|---|---|---|---|---|---|---|---|
| H | L | H | H | OFF | OFF | ON | OFF | V3 |
| H | L | L | L | OFF | ON | OFF | OFF | V2 |
| H | H | H | L | OFF | OFF | OFF | ON | V5 |
| L | L | H | L | ON | OFF | OFF | OFF | V0 |

As shown in Table 4, conduction and cutoff of the transistors (Tr) 41 to 44 are controlled on the basis of the level of the signals A1 to A4 shown in Tables 2 and 3. In the output buffer 14, one of the transistors 41 to 44 is put into conduction state and the voltage supplied to the transistor in conduction state is outputted through the output terminal 15. The three transistors other than the transistor in conduction state remain cutoff.

In the driving circuit 11, the transistors are configured so as to withstand a high voltage. Therefore, the signals which are to be applied to the gates so that the respective transistors conduct, and those output from the transistors have a high voltage level. In Tables 1 to 4, the levels of the signals FR, DA, and A1 to A4 are indicated merely by one of high and low levels. Actually, however, the signals are appropriately determined so as to have a level which can put the respective transistors into conduction/cutoff state.

Figure 5:
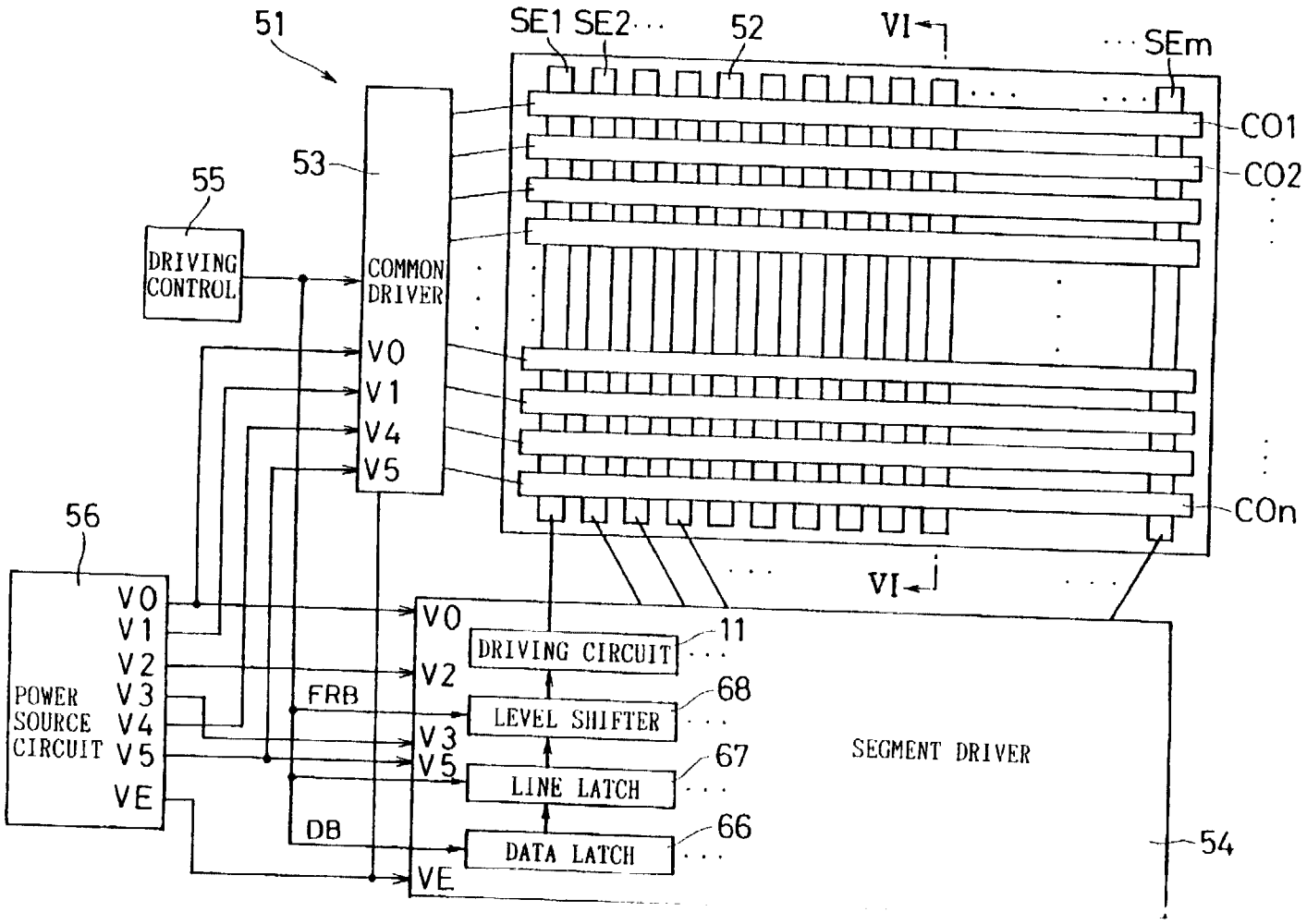
FIG. 5 is a block diagram showing a basic constitution of a liquid crystal display apparatus 51.
Figure 6:
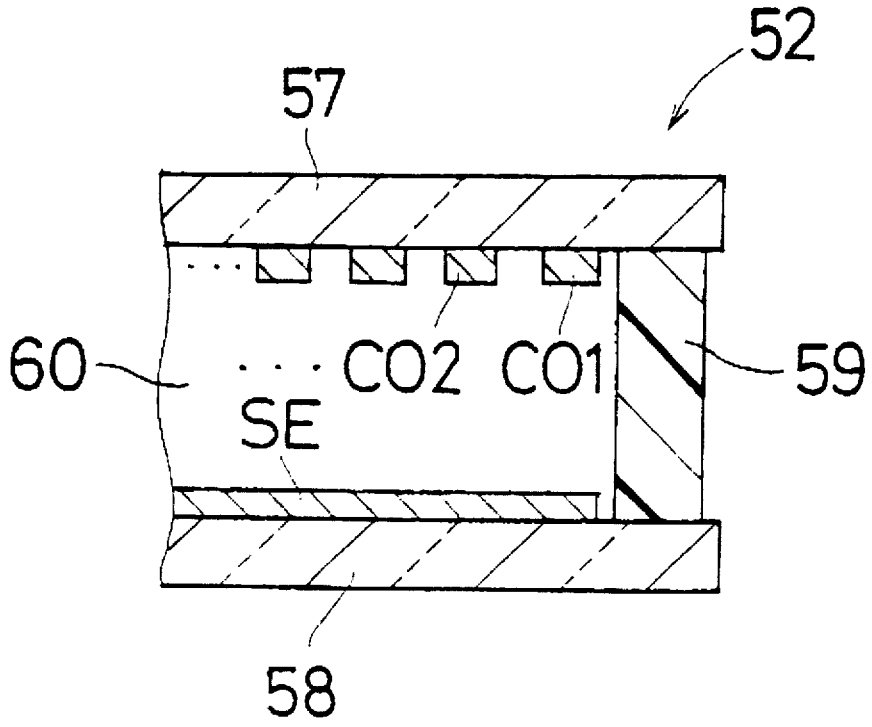
FIG. 6 is a schematic section view of a liquid crystal display panel 52 taken along a section line VI—VI of FIG. 5.

FIG. 5 is a block diagram showing a basic constitution of a liquid crystal display apparatus 51, and FIG. 6 is a schematic section view of a liquid crystal display panel 52 taken along a section line VI—VI of FIG. 5. The liquid crystal display apparatus 51 comprises the liquid crystal display panel 52, a common driver 53, a segment driver 54, and a driving control circuit 55.

As shown in FIG. 6, the liquid crystal display panel 52 comprises a pair of transparent substrates 57 and 58, a seal member 59 which allows the substrates 57 and 58 to adhere to each other with a gap of a predetermined distance, and a liquid crystal layer 60 disposed between the substrates 57 and 58. Common electrodes CO are arranged at regular intervals on the substrate 57 so as to elongate in parallel. Segment electrodes SE are arranged at regular intervals on the substrate 58 so as to elongate in a direction perpendicular to the common electrodes CO. In the liquid crystal display panel 52, the common electrodes CO are connected to the common driver 53, and the segment electrodes SE to the segment driver 54. In the liquid crystal display apparatus 51, the common driver 53 and the segment driver 54 selectively apply a voltage to the electrodes CO and SE on the basis of a control signal and the like supplied from the driving control circuit 55, thereby conducting the display operation.

In the segment driver 54, for each of the segment electrodes SE, disposed are a data latch circuit 66, a line latch circuit 67, a level shifter 68, and the driving circuit 11. Data signals DB supplied from the driving control circuit 55 are latched by the data latch circuits 66. After data signals DB corresponding to the segment electrodes SE1 to SEm or for one horizontal scanning period are latched by the data latch circuits 66, the data signals are transferred to the respective line latches 67. The line latches 67 output the data signals DB for one horizontal scanning period to the level shifters 68. When the input signal is at low level, each level shifter 68 converts the signal to the ground voltage VG or a predetermined reference voltage equal to or lower than the voltage VE, and, when the input signal is at high level, amplifies the signal to the voltage VE and outputs the amplified signal as the data signal DA.

The data signal DA the voltage level of which is converted by the level shifter 68 is inputted to the driving circuit 11. The driving control circuit 55 inputs an AC-converting signal FRB to the level shifter 68. The level shifter 68 converts the level of the AC-converting signal FRB in the same manner as the data signal DB, and outputs the level-converted signal as the AC-converting signal FR.

Figure 7:
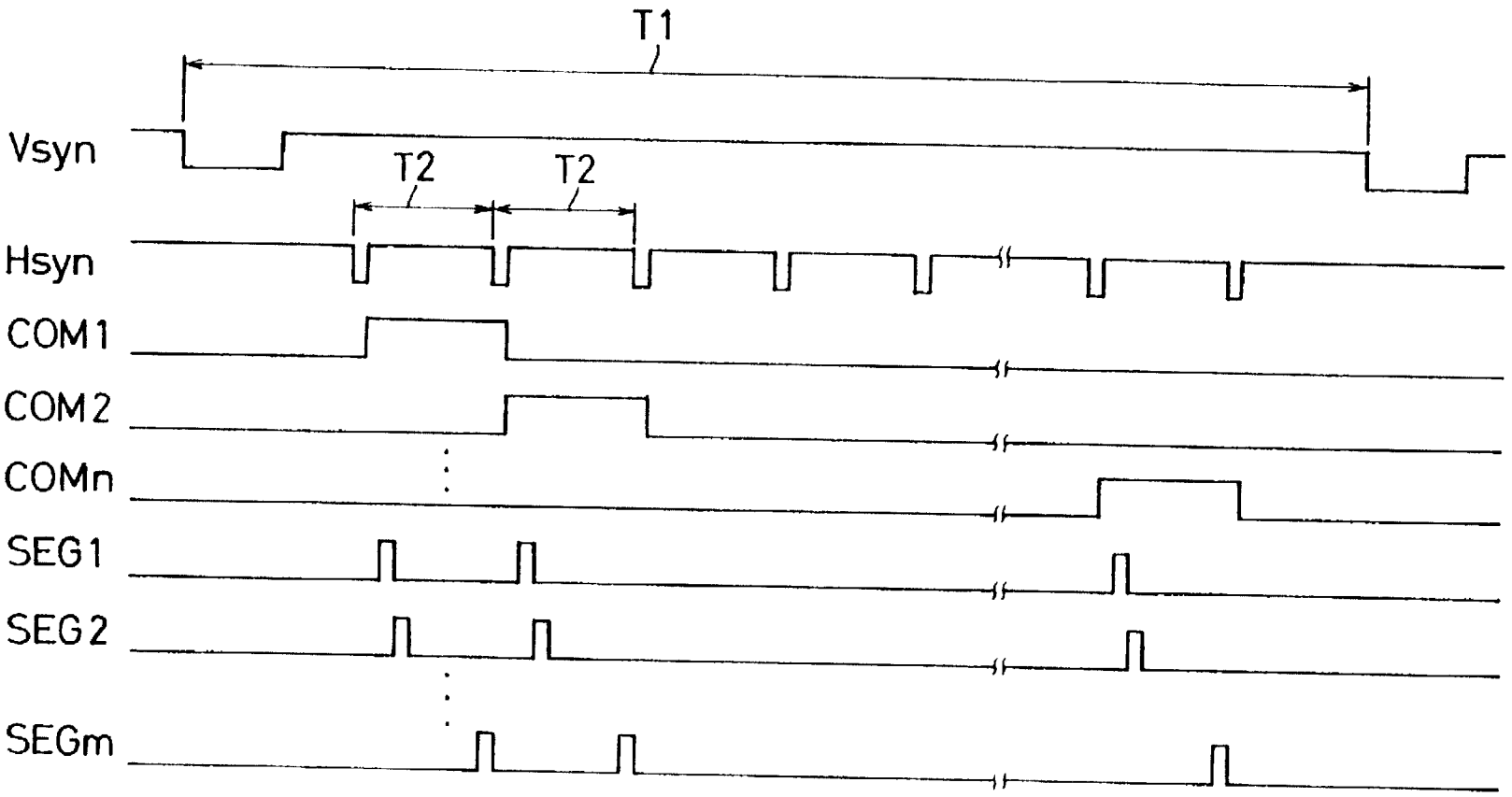
FIG. 7 is a timing chart of signals inputted to the liquid crystal display panel 52.

FIG. 7 is a timing chart of signals inputted to the liquid crystal display panel 52. In the timing chart, an electrode and a signal supplied to the electrode are indicated by the same symbol. In each period of the vertical synchronizing signal Vsyn, a horizontal synchronizing signal Hsyn is generated for each of the common electrodes CO1 to COn. In the period T1 based on the vertical synchronizing signal Hsyn, horizontal scanning intervals T2 which are equal in number to the common electrodes CO are determined by the horizontal synchronizing signals Hsyn. In the horizontal scanning intervals T2, common electrode driving signals COM1, COM2, . . . , COMn each indicating the common electrode CO to which a voltage for the selected state (described later) is to be applied are sequentially set to be at high level. During a period when the common electrode driving signals COM is at high level, segment electrode driving signals SEG1, SEG2, . . . , SEGm each indicating the segment electrode SE to which a voltage for the selected state (described later) is to be applied are set to be at high level so that a voltage defined by the data signal DA is applied to the segment electrodes SE.

Figure 8:
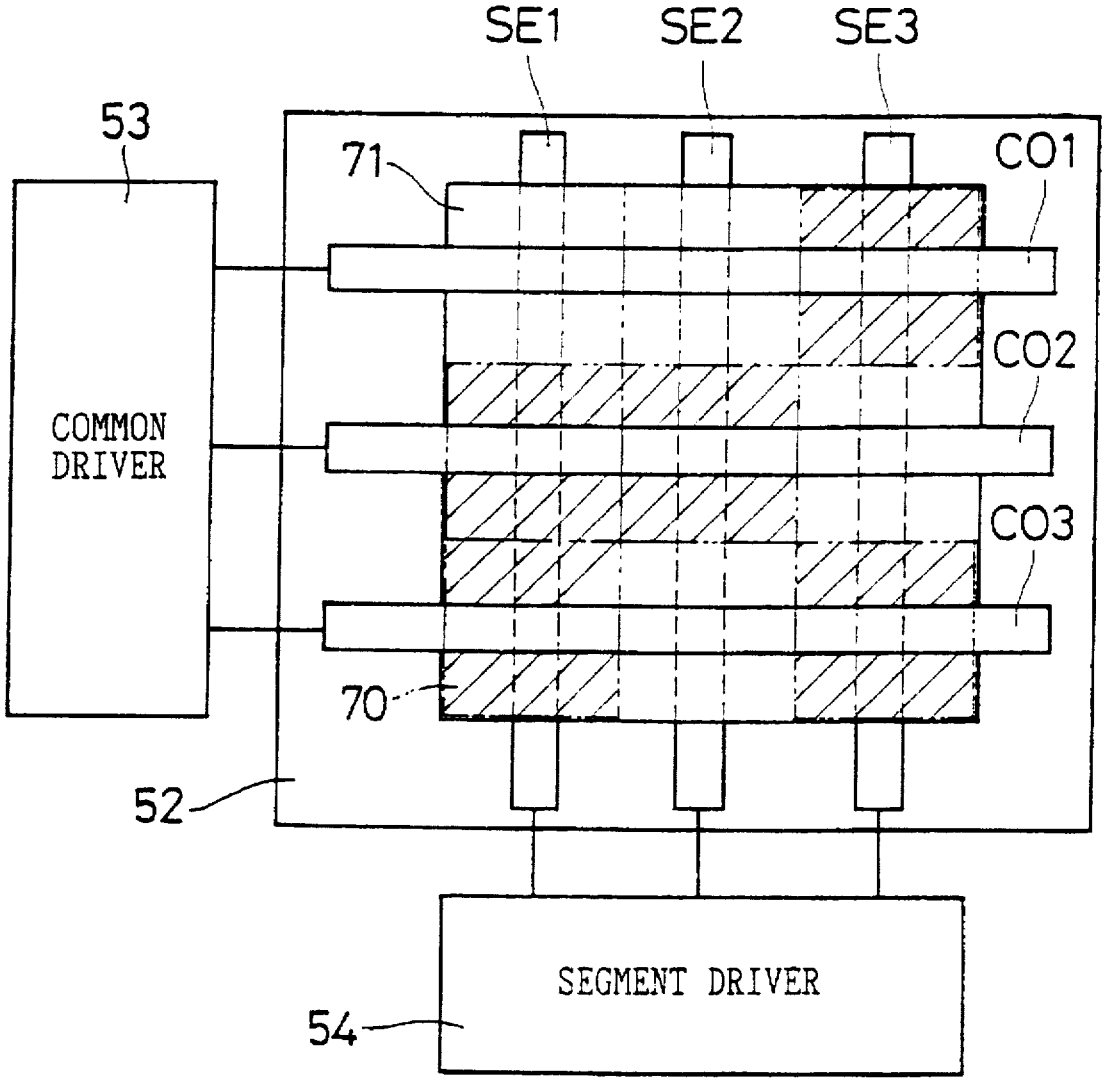
FIG. 8 is a diagram showing a display example of the liquid crystal display panel 52.
Figure 9:
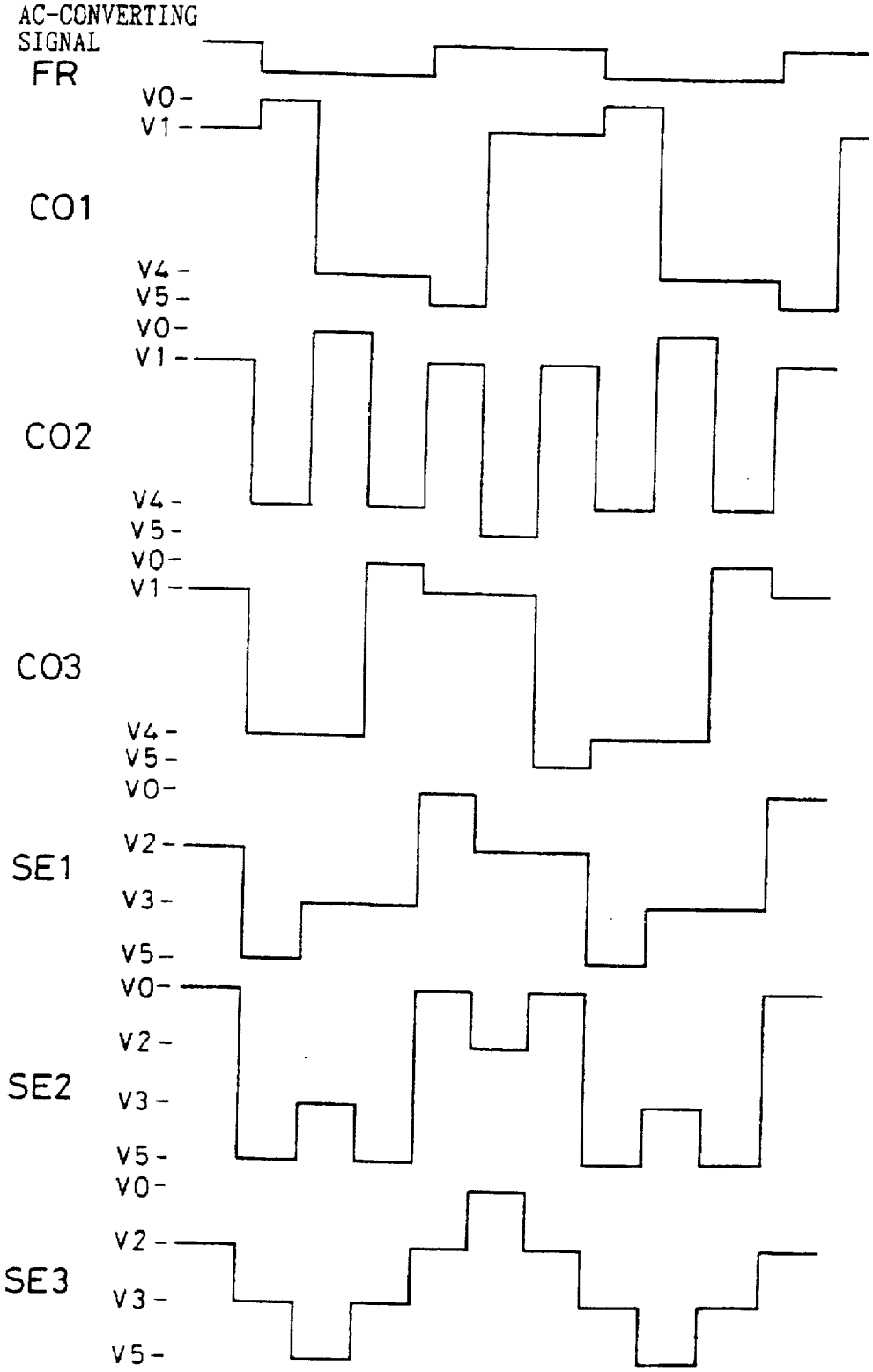
FIG. 9 is a waveform chart of display signals in the liquid crystal display panel 52 shown in FIG. 8.

In the liquid crystal display panel 52 of 3 rows×3 columns, shown in FIG. 8, hatched portions 70 indicate the light-off state, and blank portions 71 the light-on state. FIG. 9 shows the waveforms of the outputs from the common driver 53 to the common electrodes C01, C02, and C03, those of the outputs from the segment driver 54 to the segment electrodes SE1, SE2, and SE3, and the AC-converting signal FR. The crossing point of the common electrode C01 and the segment electrode SE2 is in the light-on state, and that of the common electrode C02 and the segment electrode SE2 is in the light-off state.

Figure 10A:
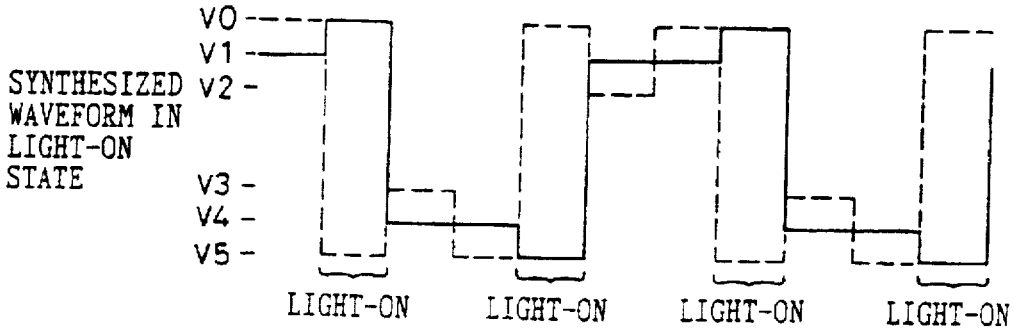
FIG. 10A is a waveform chart in which signals at a crossing point where the light-on state is to be attained are synthesized with each other.
Figure 10B:
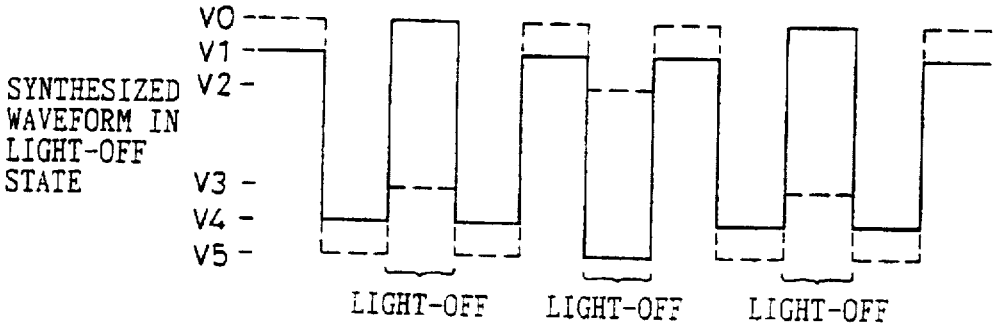
FIG. 10B is a waveform chart in which signals at a crossing point where the light-off state is to be attained are synthesized with each other.

FIG. 10A shows the voltage waveform which is obtained by synthesizing waveforms of outputs for an electrode in which the light-on state is to be attained, and FIG. 10B shows the voltage waveform which is obtained by synthesizing waveforms of outputs for an electrode in which the light-off state is to be attained. In FIGS. 10A and 10B, the common output voltage indicated by the solid line at V0 or V5 is in the selected state, and that at V1 or V4 is in the nonselected state. The segment output voltage indicated by the broken line at V0 or V5 is in the selected state, and that at V2 or V3 is in the nonselected state. In other words, when the voltage V0 is applied to the common electrode CO, the orthogonal point of the common electrode to which the voltage V0 is applied and the segment electrode SE to which the voltage V5 is applied is lit on, and, when the voltage V5 is applied to the common electrode CO, the orthogonal point of the common electrode to which the voltage V5 is applied and the segment electrode SE to which the voltage V0 is applied is lit on. When the voltage V0 is applied to the common electrode CO, the orthogonal point of the common electrode to which the voltage V0 is applied and the segment electrode SE to which the voltage V3 is applied is put into light-off state, and, when the voltage V5 is applied to the common electrode CO, the crossing point of the common electrode and the segment electrode SE to which the voltage V2 is applied becomes the light-off state.

Figure 11:
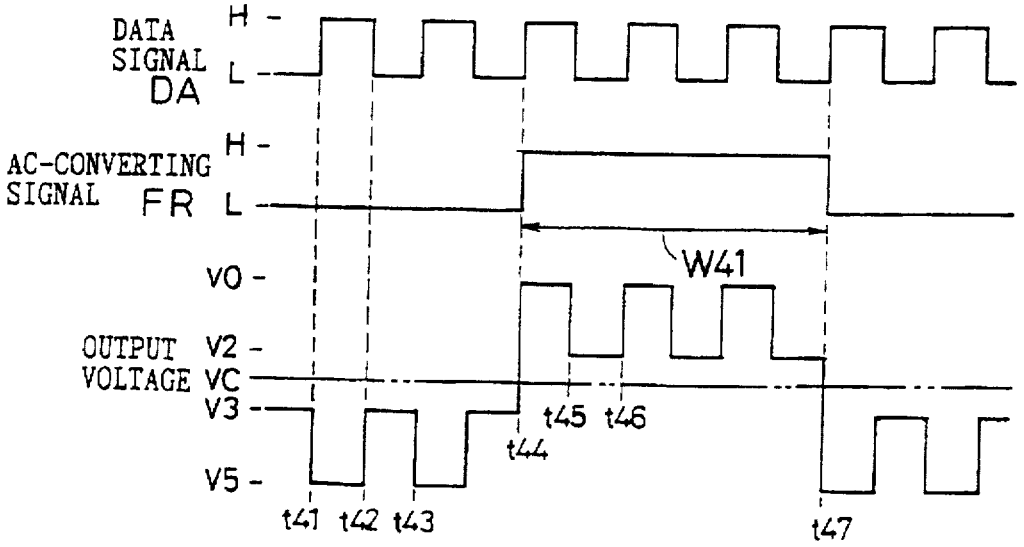
FIG. 11 is a timing chart of signals in the driving circuit 11.

FIG. 11 is a timing chart of signals in the driving circuit 11. Between times t41 to t42, the AC-converting signal FR is at low "L" level, and the data signal DA is at high "H" level. Therefore, the output voltage is V5. Between times t42 to t43, the AC-converting signal FR is at low level, and the data signal DA is at low level, too. Therefore, the output voltage is V3.

Between times t44 to t45, the AC-converting signal FR is at high level, and the data signal DA is at high level. Therefore, the output voltage is V0. An intermediate voltage between the voltages V0 and V5 is indicated by VC. Between times t45 to t46, the AC-converting signal FR is at high level, but the data signal DA is at low level. Therefore, the output voltage is V2. The difference between the voltage V2 and the voltage VC is equal to that between the voltage V3 and the voltage VC.

At time t45, the AC-converting signal FR is at low level, and the data signal DA is at high level. Therefore, the output voltage is V5. During the period from time t44 to t47, for example, the AC-converting signal FR is alternatingly changed for each period W41 from high level to low level and vice versa.

In the above description, the driving circuit 11 is used in the segment driver 54. When the voltages supplied to the output buffer 14 and the AC-converting signal FR inputted to the first switching circuit 12 are appropriately changed, the driving circuit may be used in the common driver 53 of the liquid crystal display apparatus 51.

Figure 12:
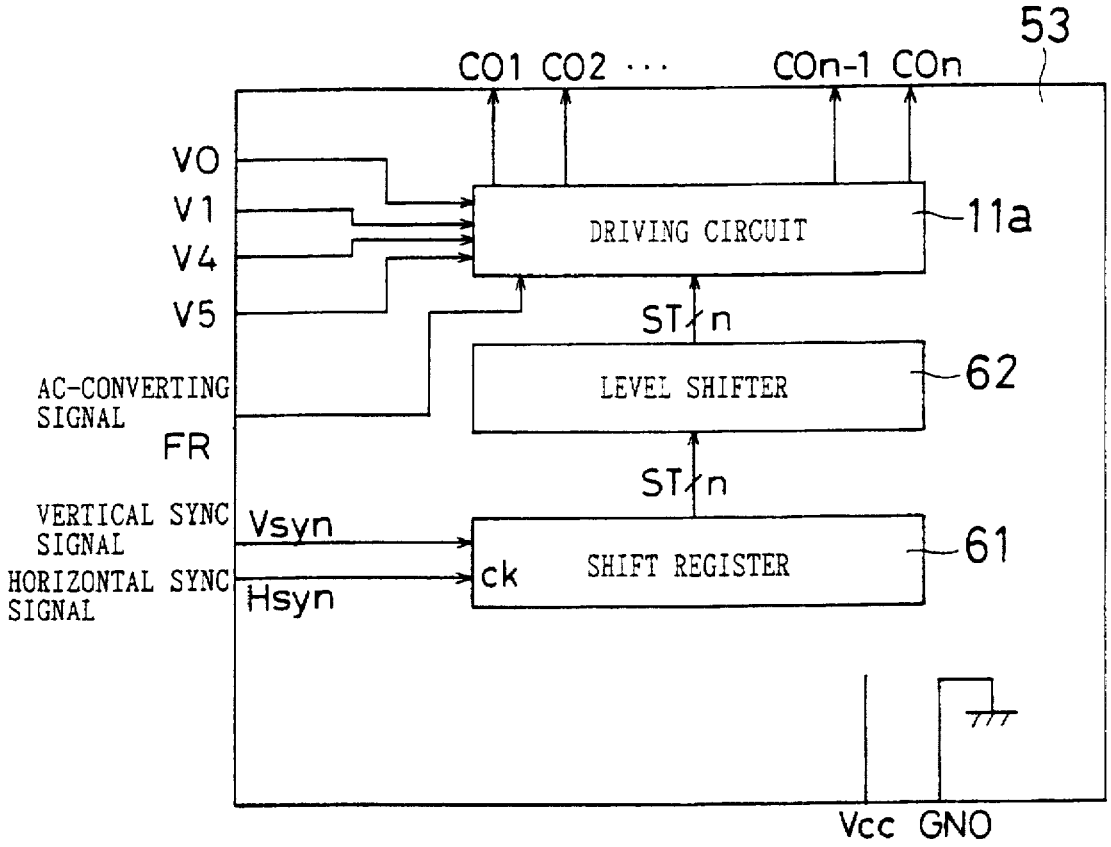
FIG. 12 is a block diagram showing a constitution of a common driver 53.

FIG. 12 is a block diagram showing a constitution of the common driver 53. The common driver 53 comprises a shift register 61, a level shifter 62, and a driving circuit 11*a*. The shift register 61 outputs a scan timing signal ST on the basis of the vertical synchronizing signal Vsyn and horizontal synchronizing signal Hsyn. The level shifter 62 shifts the level of the signal outputted from the shift register 61 and outputs the level-shifted signal. The driving circuit 11*a* outputs the common electrode driving signals COM1, COM2, . . . , COMn, on the basis of the output (the level-shifted scan timing signal ST) of the level shifter 62, the AC-converting signal FR, and the power source voltages V0, V1, V4, and V5.

Figure 13:
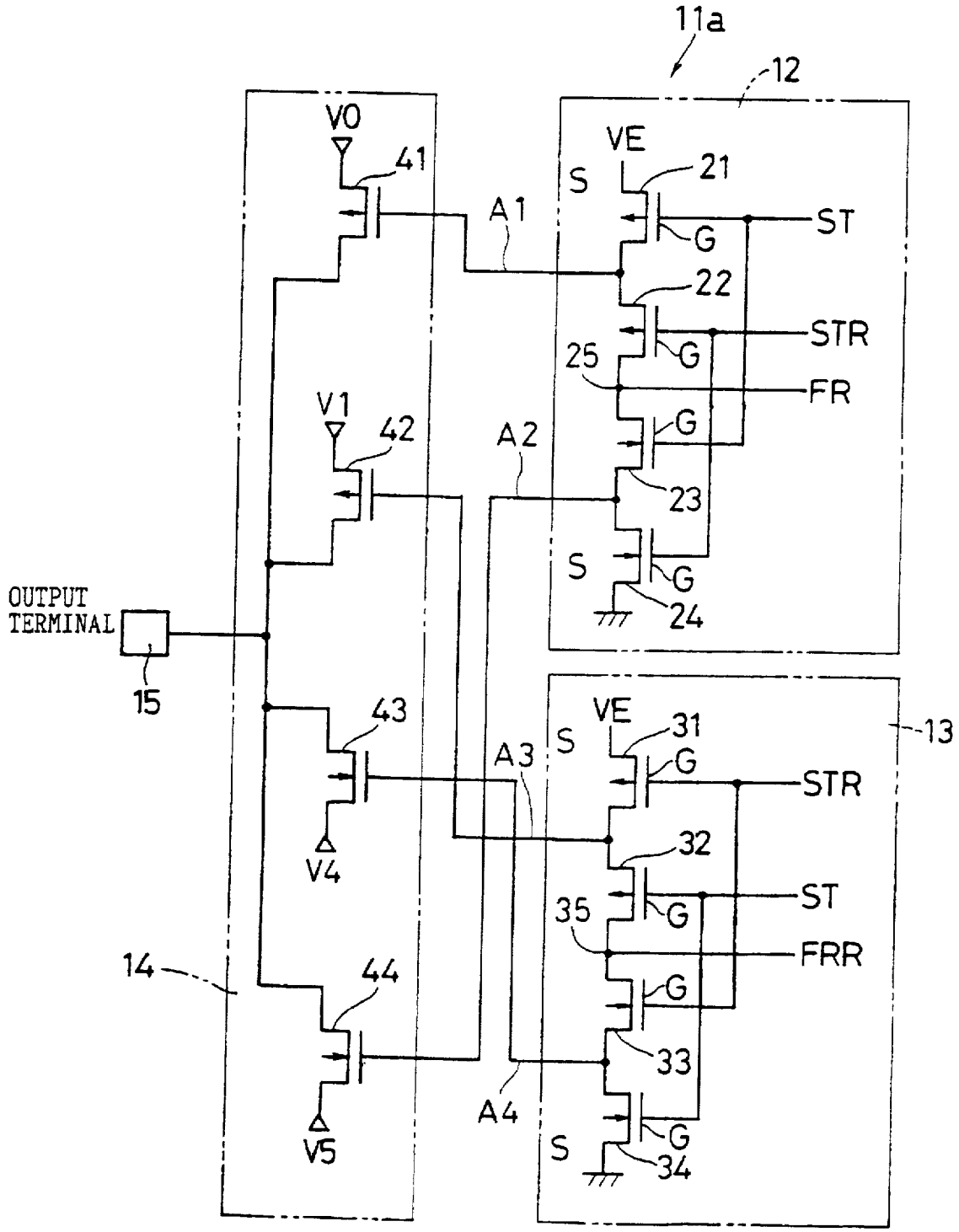
FIG. 13 is a circuit diagram of a driving circuit 11*a* of another constitution example of the first embodiment of the invention.

FIG. 13 is a circuit diagram of the driving circuit 11*a* of the common driver 53. The driving circuit 11*a* is configured by the same components as those of the driving circuit 11. Therefore, the components are designated by the same reference numerals and their description is omitted. The driving circuit 11*a* is different from the driving circuit 11 in three points as follows. First, in the driving circuit 11*a*, the signal supplied to the node 25 of the first switching circuit 12 is the AC-converting signal FR in contrast to that, in the driving circuit 11, the supplied signal is the inverted AC-converting signal FRR. Second, in the driving circuit 11*a*, the signals supplied to the gates G of the transistors of the first and second switching circuits 12 and 13 are the scan timing signal ST and the inverted scan timing signal STR in contrast to that, in the driving circuit 11, the supplied signals are the data signal DA and the inverted data signal DAR. Third, the voltage V1 which is determined so as to be V0>V1>V2 is supplied to the transistor 42 of the output buffer 14, and the voltage V4 which is determined so as to be V3>V4>V5 is supplied to the transistor 43.

Figure 14:
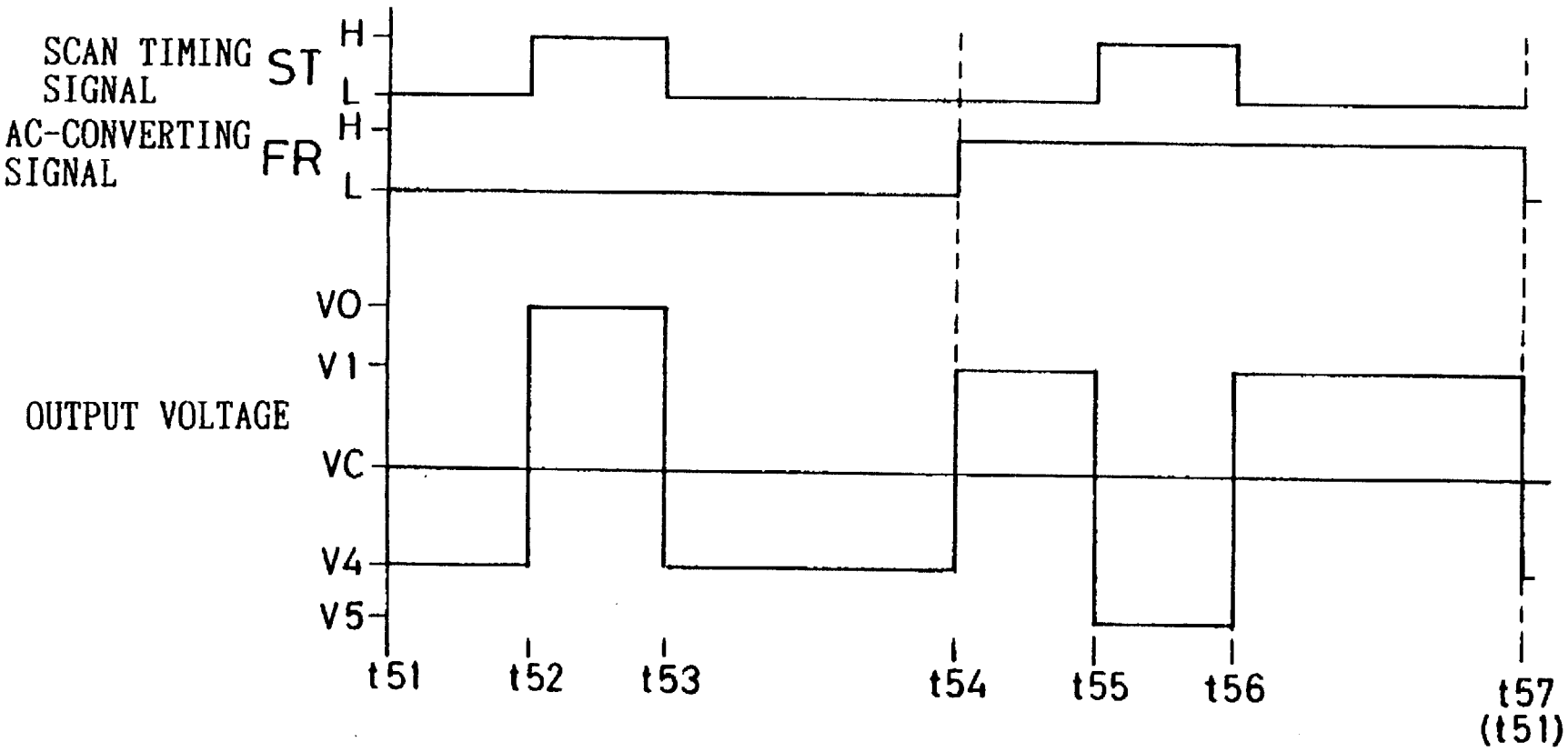
FIG. 14 is a timing chart of signals in the driving circuit 11*a;*

FIG. 14 is a timing chart of signals in the driving circuit 11*a*. When the AC-converting signal FR falls from high level to low level at time t51, the output voltage becomes V4 because the scan timing signal ST is at low level. When the scan timing signal ST rises at time t52, the output voltage becomes V0 because the AC-converting signal FR is at low level. When the scan timing signal ST falls from high level to low level at time t53, the output voltage becomes V4 because the AC-converting signal FR is at low level.

When the AC-converting signal FR rises from low level to high level at time t54, the output voltage becomes V1 because the scan timing signal ST is at low level. When the scan timing signal ST rises from low level to high level at time t55, the output voltage becomes V5 because the AC-converting signal FR is at high level. When the scan timing signal ST falls from high level to low level at time t56, the output voltage becomes V1 because the alternating signal FR is at high level.

In a switching circuit of the prior art, in order to output a high voltage, eight transistors must be configured so as to withstand the high voltage. By contrast, according to the embodiment of the invention, each of the first and second switching circuits 12 and 13 is configured by four transistors, and hence the circuit portion configured so as to withstand a high voltage can be reduced in size so that the area where the driving circuits 11 and 11*a* for selectively outputting voltages for driving the liquid crystal is reduced. As a result, it is possible to realize a very slim chip which can cope with: the increased number of outputs due to tendencies of enlargement, high resolution, and colored display of a liquid crystal display panel; reduction of the frame region which is the perimeter of the liquid crystal display panel and in which the segment driver 54 and the common driver 53 are to be formed; and miniaturization of the package.

Figure 3:
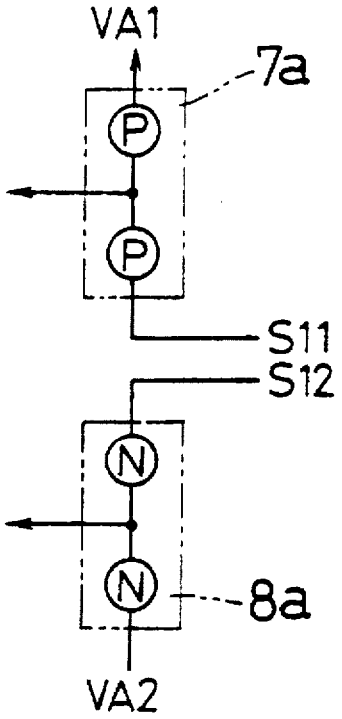
FIG. 3 is a diagram showing a basic concept of a second embodiment of the invention.
Figure 15:
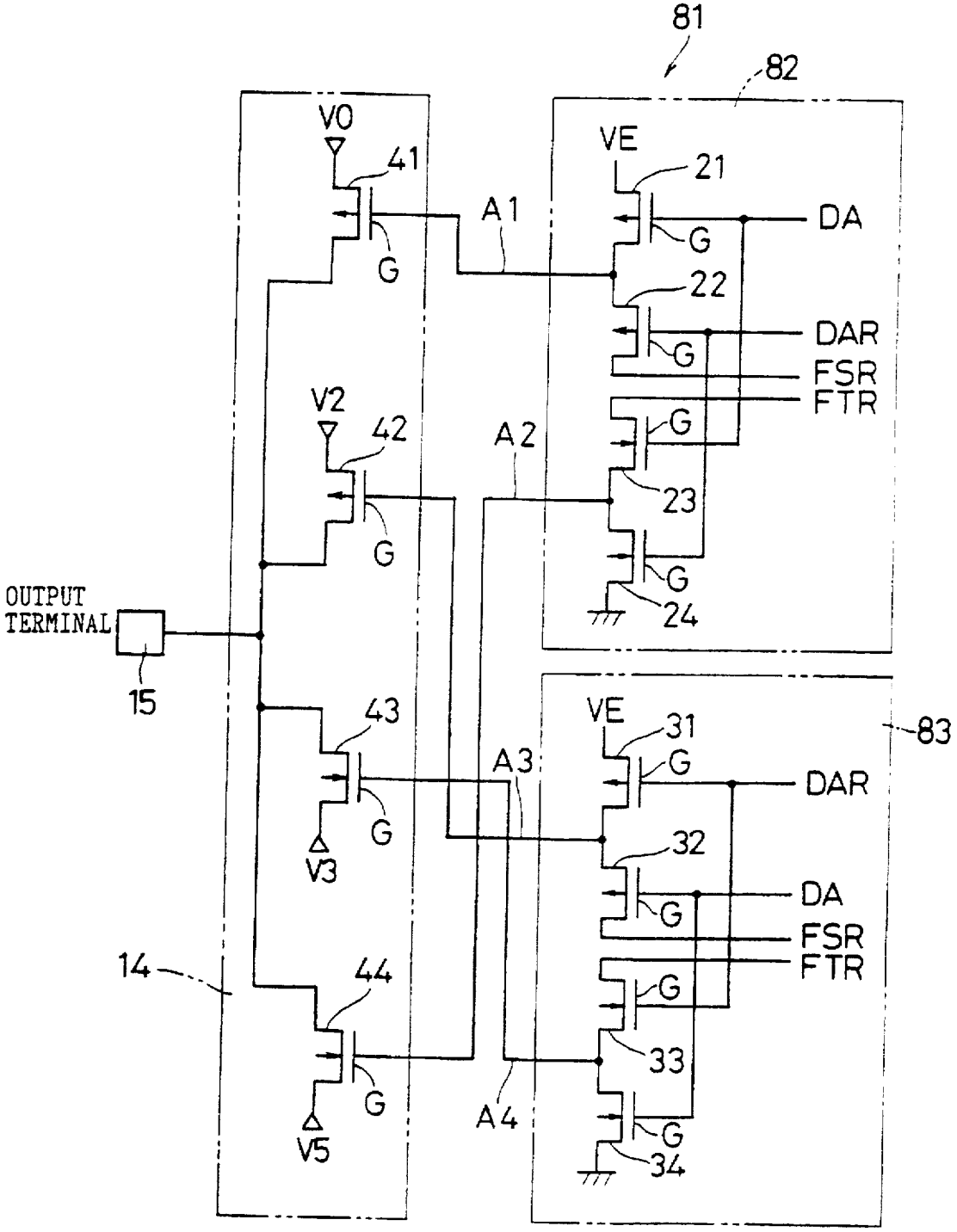
FIG. 15 is a circuit diagram of a signal electrode driving circuit 81 of a second embodiment of the invention.

FIG. 15 is a circuit diagram of a signal electrode driving circuit 81 of a second embodiment of the invention. FIG. 3 shows a basic concept of the embodiment of the invention. In the driving circuit 81, the components identical with those of the driving circuit 11 are designated by the same reference numerals and their description is omitted.

The driving circuit 81 of the embodiment is characterized in that, in place of the AC-converting signal FR, signals FSR and FTR which are respectively obtained by inverting first and second AC-converting signals FS and FT that are different in phase from each other are supplied to the driving circuit 81. In the same manner as the first switching circuit 12, a first switching circuit 82 of the driving circuit 81 comprises the transistors 21 to 24, but the transistors 22 and 23 are not connected to each other. The signal FSR is supplied to the transistor 22, and the signal FTR to the transistor 23. The manner of connecting the other components, and the supplied signals and voltages are the same as those of the first switching circuit 12.

When the inverted data signal DAR is at low level, the inverted first AC-converting signal FSR is supplied to the gate G of the transistor 41. When the data signal DA is at high level, the inverted second AC-converting signal FTR is supplied to the gate G of the transistor 44.

In the same manner as the second switching circuit 13, a second switching circuit 83 of the driving circuit 83 comprises the transistors 31 to 34, but the transistors 32 and 33 are not connected to each other. The signal FSR is supplied to the transistor 32, and the signal FTR to the transistor 33. When the data signal DA is at low level, the signal FSR is supplied to the gate G of the transistor 42. When the inverted data signal DAR is at high level, the signal FTR is supplied to the gate G of the transistor 43.

Figure 16:
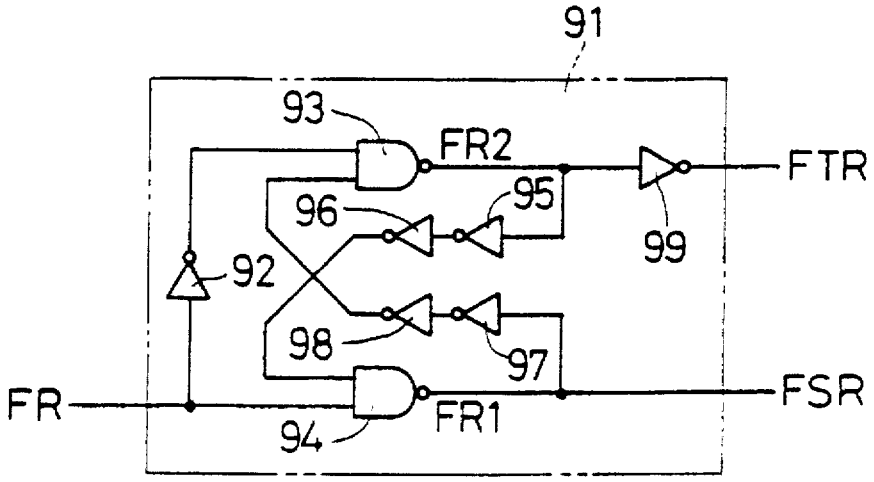
FIG. 16 is a circuit diagram of an AC-converting signal generation circuit 91.
Figure 17:
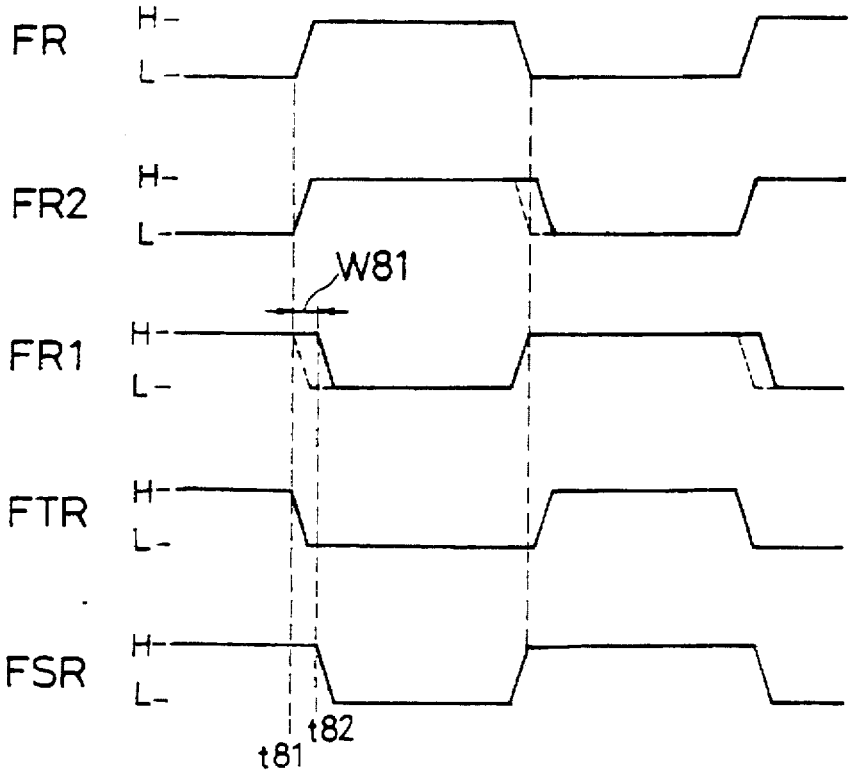
FIG. 17 is a timing chart of signals in the AC-converting signal generation circuit 91.

FIG. 16 is a circuit diagram of an AC-converting signal generation circuit 91, and FIG. 17 is a timing chart of signals in the AC-converting signal generation circuit 91. The AC-converting signal generation circuit 91 comprises inverters 92 and 95 to 99, and NAND gates 93 and 94.

The AC-converting signal FR inputted to the AC-converting signal generation circuit 91 is supplied to one input of the NAND gate 94. The AC-converting signal FR is supplied also to one input of the NAND gate 93 through the inverter 92. The output of the inverter 98 is supplied to the other input of the NAND gate 93. The signal FR2 which is the output of the NAND gate 93 is supplied to the inverter 99 to be outputted as the signal FTR. The signal FR2 is supplied also to the other input of the NAND gate 94 through the inverters 95 and 96. The signal FR1 which is the output of the NAND gate 94 is outputted as the signal FSR. Furthermore, the signal FR1 is supplied to the other input of the NAND gate 93 through the inverters 97 and 98.

In FIG. 17, when the AC-converting signal FR rises from low level to high level at time t81, the signal FR2 rises from low level to high level. The signal FR1 falls to low level at time t82 which is later than time t81 by a period W81. When the signal FR2 rises at time t81, the signal FTR falls.

As described above, the AC-converting signal generation circuit 91 generates the signals FSR and FTR which are different in phase from each other, on the basis of the AC-converting signal FR, and outputs the signals.

Figure 18:
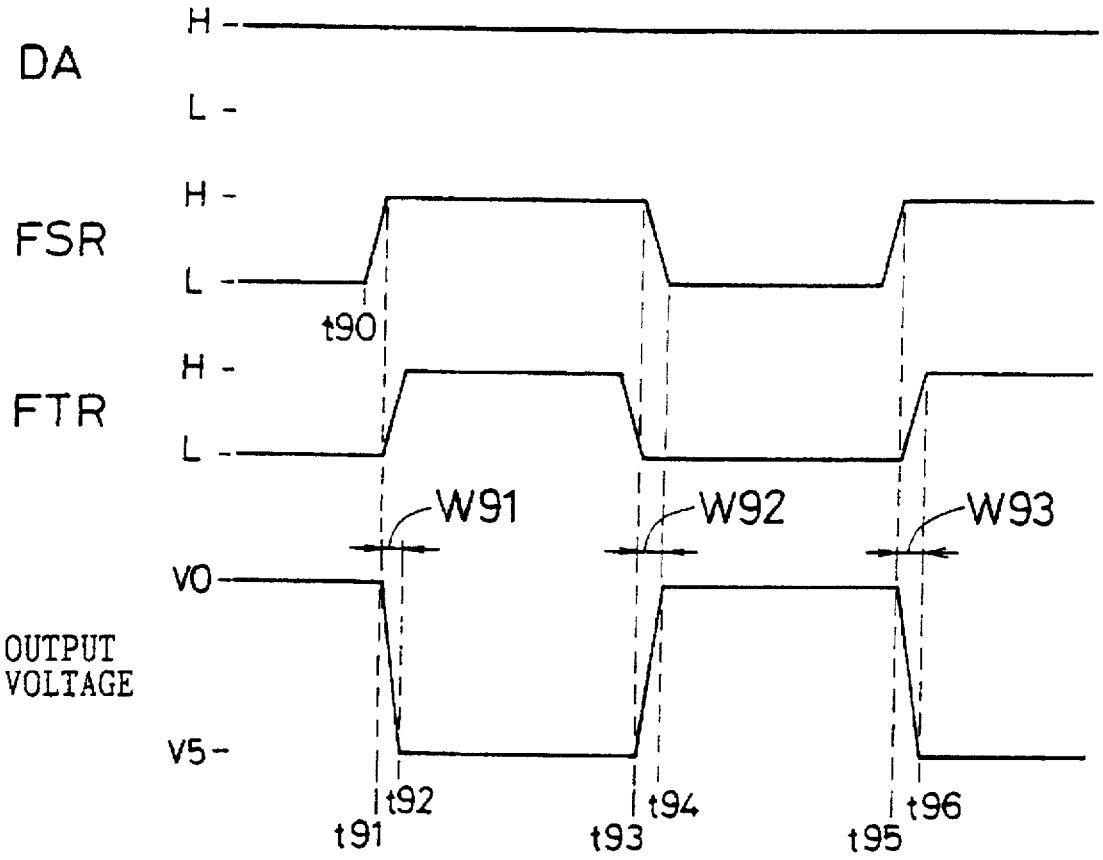
FIG. 18 is a timing chart of signals in the signal electrode driving circuit 81.
Figure 19:
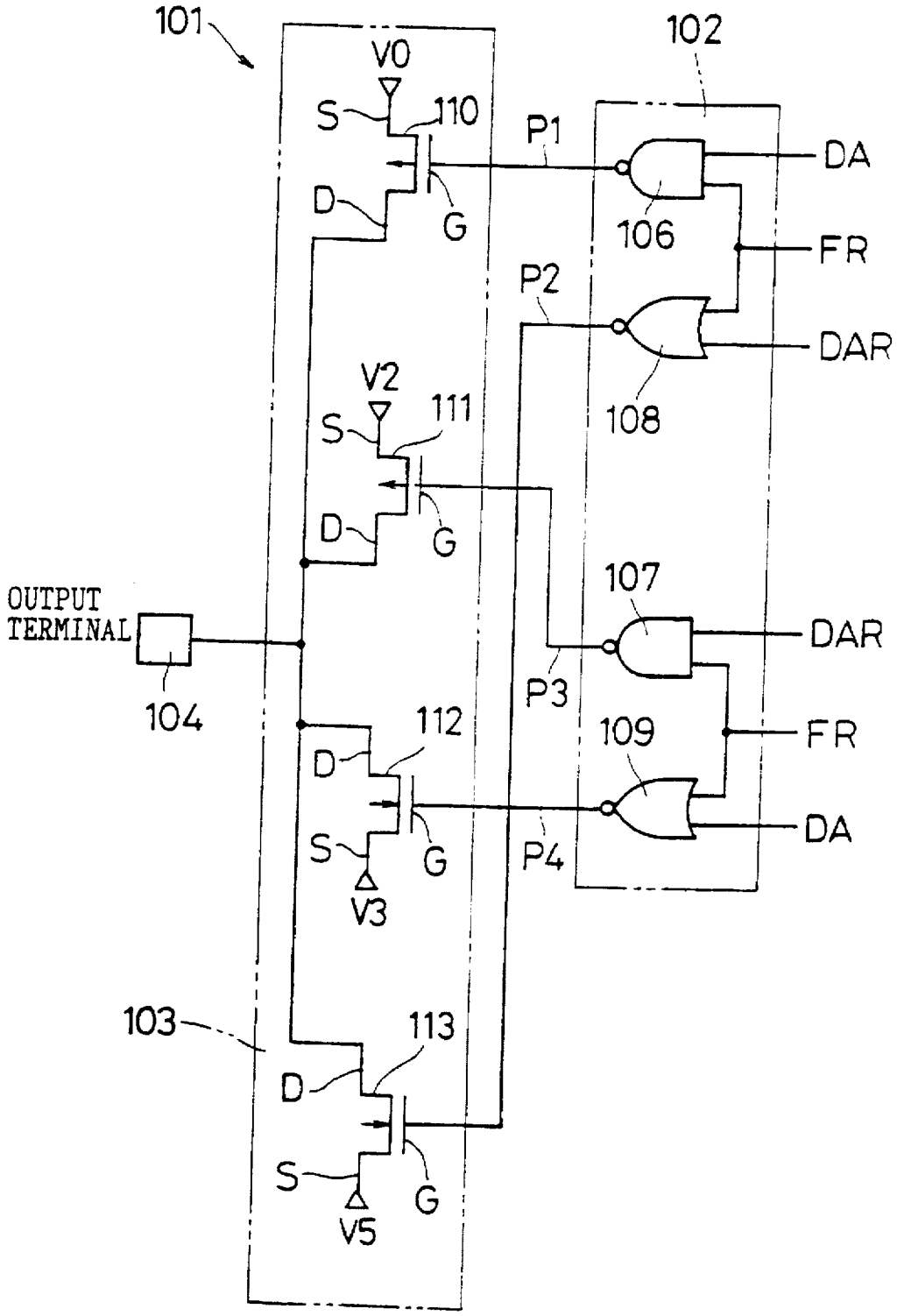
FIG. 19 PRIOR ART
FIG. 19 is a circuit diagram of a driving circuit 101 of a typical prior art.
Figure 20:
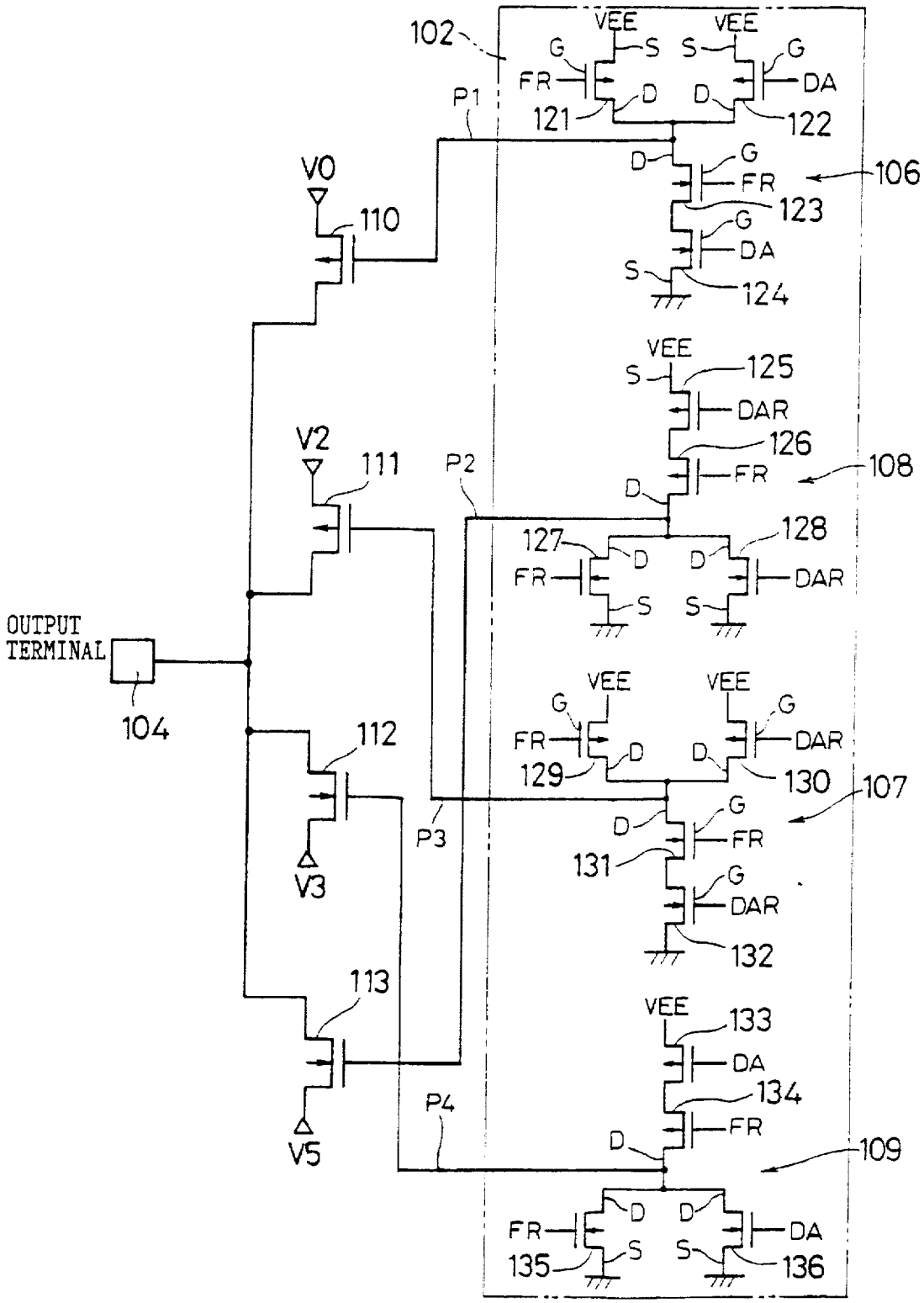
FIG. 20 PRIOR ART
FIG. 20 is a circuit diagram showing the driving circuit 101 more specifically in terms of transistors.

FIG. 18 is a timing chart of signals in the signal electrode driving circuit 81. In the timing chart, it is assumed that the data signal DA is always of high level. Therefore, either of the transistors 41 and 44 is put into ON-state in accordance with the levels of the AC-converting signals FTR and FSR, so that the voltage V0 or V5 is outputted through the output terminal 15.

The signal FSR starts to rise at time t90 and increases toward high level. The output voltage remains at V0 until time t91. The signal FSR goes to high level at time t91 so that the transistor 41 is put into OFF-state. At time t91, the signal FTR starts to rise but the transistor 44 remains in OFF-state. When the signal FTR goes to high level at time t92, the transistor 44 is put into ON-state and the output voltage becomes V5.

During the period W91 between time t91 when the transistor 41 is put into OFF-state and time t92 when the transistor 44 is put into ON-state, therefore, both the transistors 41 and 44 are put into OFF-state and hence a through current is prevented from flowing. The transistor 44 is turned OFF when the signal FTR becomes low level at time t93, but the transistor 41 remains turned OFF until the signal FSR falls to low level at time t94. During the period W92 between times t93 to t94, therefore, both the transistors 41 and 44 are turned OFF. Also during the period W93 between times t95 to t96, the time when the signal FTR rises to high level is delayed from that when the signal FSR rises to high level, and hence both the transistors 41 and 44 are turned OFF.

When the output voltage is to be switched, therefore, a period when both the transistor for outputting the voltage before the switching and that for outputting the voltage after the switching are turned OFF is provided. Consequently, a through current is prevented from flowing through the driving circuit 81, and the power consumption of a display apparatus provided with the driving circuit 81 can be reduced.

During the periods W91, W92, and W93, the output voltage has a value corresponding to none of the voltages, thereby producing a high-impedance state. However, the capacitance formed by the electrode connected to the output terminal 15, the electrodes opposing the electrode, and the dielectric layer prevents the display of the display panel from being adversely affected.

As described above, according to the embodiment of the invention, the signals FTR and FSR which are different in phase from each other are supplied to the switching circuits and 83. Therefore, two transistors in the output buffer 14 are not simultaneously put into ON-state, thereby preventing a through current from flowing. Since a through current is prevented from flowing, the power consumption of the driving circuit 81 can be reduced.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A multiple value voltage output circuit which selectively outputs one of plural voltages in accordance with a first input signal whose level is shifted at intervals of a predetermined period from a first power source potential to a second power source potential or from the second power source potential to the first power source potential, and in accordance with a second input signal whose level is determined to be one of the first and second power source potentials at intervals of a predetermined reference period shorter than the predetermined period, the multiple value voltage output circuit comprising:

plural first switching devices each having one end connected to a corresponding voltage among the plural voltages and another end connected to an output terminal in common; and a control circuit for outputting a control signal by which one of the plural first switching devices is put into conduction state, and the others of the plural first switching devices are put into cutoff state, wherein the control circuit comprises a logic circuit for each first switching device composed of two second switching devices which are cascade-connected to each other, either of the cascade-connected second switching devices is put into conduction state in accordance with the second input signal, the first or second power source potential is supplied to one end of the cascade-connected second switching devices, the first input signal is supplied to the other end of the cascade-connected second switching devices, and a potential of the node of the cascade-connected second switching devices is used as the control signal for the corresponding first switching device.

2. The multiple value voltage output circuit of claim 1, wherein the first switching device connected to a voltage of a value equal to or higher than a predetermined value is composed of a P-channel transistor, and the logic circuit which outputs the control signal to the P-channel transistor is composed of a first logic circuit configured by a circuit of cascade connected P-channel transistors, to one end of which a power source potential for putting the P-channel transistor into cutoff state is supplied, and wherein the first switching device connected to a voltage of a value lower than the predetermined value is composed of an N-channel transistor, and the logic circuit which outputs the control signal to the N-channel transistor is composed of a second logic circuit configured by a circuit of cascade-connected N-channel transistors, to one end of which a power source potential for putting the N-channel transistor into cutoff state is supplied.

3. The multiple value voltage output circuit of claim 2, wherein the first and second logic circuits are cascade-connected between the first and second power source potentials, and the first input signal is supplied to the node of the first and second logic circuits.

4. The multiple value output circuit of claim 2, wherein the first input signal supplied to the other end of the first logic circuit is made different in phase from the first input signal supplied to the other end of the second logic circuit, to ensure a period during which, when the levels of the first input signals are shifted, the voltages of both ends of all the logic circuits are equal to each other.

5. The multiple value output circuit of any one of claims 1 to 4, the multiple value output circuit being a liquid crystal segment driving circuit wherein the first input signal is an AC-converting signal whose level is shifted for each frame, and the second input signal is a data signal whose level is determined in accordance with data to be displayed.

6. The multiple value output circuit of any one of claims 1 to 4, the multiple value output circuit being a liquid crystal common driving circuit wherein the first input signal is an AC-converting signal whose level is shifted for each frame, and the second input signal is a scanning timing signal.

* * * * *